US008912870B2

(12) United States Patent
Marushima et al.

(10) Patent No.: US 8,912,870 B2
(45) Date of Patent: Dec. 16, 2014

(54) SWITCHGEAR AND SWITCHGEAR OPERATING MECHANISM

(71) Applicant: Kabushiki Kaisha Toshiba, Tokyo (JP)

(72) Inventors: Satoshi Marushima, Kanagawa (JP); Yoshikata Kobayashi, Tokyo (JP); Yoshiaki Ohda, Kanagawa (JP); Masaharu Shimizu, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 9 days.

(21) Appl. No.: 13/953,119

(22) Filed: Jul. 29, 2013

(65) Prior Publication Data

US 2013/0307647 A1 Nov. 21, 2013

Related U.S. Application Data

(63) Continuation-in-part of application No. PCT/JP2011/007350, filed on Dec. 28, 2011.

(30) Foreign Application Priority Data

Jan. 31, 2011 (JP) ..... 2011-018481

(51) Int. Cl.

| | |
|---|---|
| ***H01H 3/00*** | (2006.01) |
| ***H01H 9/20*** | (2006.01) |
| ***H01H 71/24*** | (2006.01) |
| ***H01H 3/30*** | (2006.01) |
| ***H01H 3/46*** | (2006.01) |
| ***H01H 3/28*** | (2006.01) |
| *H01H 33/42* | (2006.01) |

(52) U.S. Cl.

CPC ..... *H01H 71/24* (2013.01); *H01H 3/3015* (2013.01); *H01H 3/3031* (2013.01); *H01H 3/46* (2013.01); *H01H 3/28* (2013.01); *H01H 33/42* (2013.01)

USPC ..... 335/190; 335/165; 335/167; 335/169; 335/170; 335/171; 335/186; 335/189

(58) Field of Classification Search

CPC ..... H01H 3/32; H01H 50/643; H01H 3/30; H01H 3/42

USPC ..... 335/165, 167, 169–170, 171, 186, 189, 335/190; 200/400, 401, 500, 501, 318, 200/321–327, 335–337; 218/7, 14, 153, 218/154

See application file for complete search history.

(56) References Cited

U.S. PATENT DOCUMENTS

| | | |
|---|---|---|
| 7,772,513 B2 | 8/2010 | Ohda et al. |
| 8,330,065 B2 | 12/2012 | Ohda et al. |

(Continued)

FOREIGN PATENT DOCUMENTS

| | | |
|---|---|---|
| JP | 09-180593 | 7/1997 |
| JP | 2003-068172 | 3/2003 |

(Continued)

OTHER PUBLICATIONS

U.S. Appl. No. 14/345,850, filed Mar. 19, 2014, Iwasawa, et al.
International Search Report mailed Apr. 17, 2012 for PCT/JP2011/007350 filed on Dec. 28, 2011 with English Translation.

*Primary Examiner* — Mohamad Musleh
(74) *Attorney, Agent, or Firm* — Oblon, Spivak, McClelland, Maier & Neustadt, L.L.P.

(57) ABSTRACT

According to an embodiment, when a switchgear operating state is shifted from a close state to a cutoff state, a solenoid lever is pushed and rotated by a plunger of an electromagnetic solenoid for cutoff so that the solenoid lever rotates in a direction opposite from the direction of the urging of a solenoid-lever return spring. A trigger roller pin and the solenoid lever become disengaged from each other, an eccentric pin and a trigger lever are rotated by the urging force from a latch leading end become disengaged from each other, whereby a latch lever is rotated by the released energy of a cutoff spring.

23 Claims, 12 Drawing Sheets

(56) References Cited

U.S. PATENT DOCUMENTS

| | | | | |
|---|---|---|---|---|
| 8,395,067 | B2 | 3/2013 | Marushima et al. | |
| 8,420,969 | B2 | 4/2013 | Marushima et al. | |
| 2002/0056631 | A1* | 5/2002 | Ohtsuka et al. | 200/400 |
| 2008/0078666 | A1* | 4/2008 | Ohda et al. | 200/400 |
| 2010/0126967 | A1* | 5/2010 | Ohda et al. | 218/154 |
| 2011/0000768 | A1* | 1/2011 | Marushima et al. | 200/50.24 |
| 2011/0073446 | A1* | 3/2011 | Marushima et al. | 200/50.24 |

FOREIGN PATENT DOCUMENTS

| | | |
|---|---|---|
| JP | 3497866 | 11/2003 |
| JP | 2007-294363 | 11/2007 |
| JP | 2009-032560 | 2/2009 |
| JP | 2009-238700 | 10/2009 |

* cited by examiner

FIG. 9
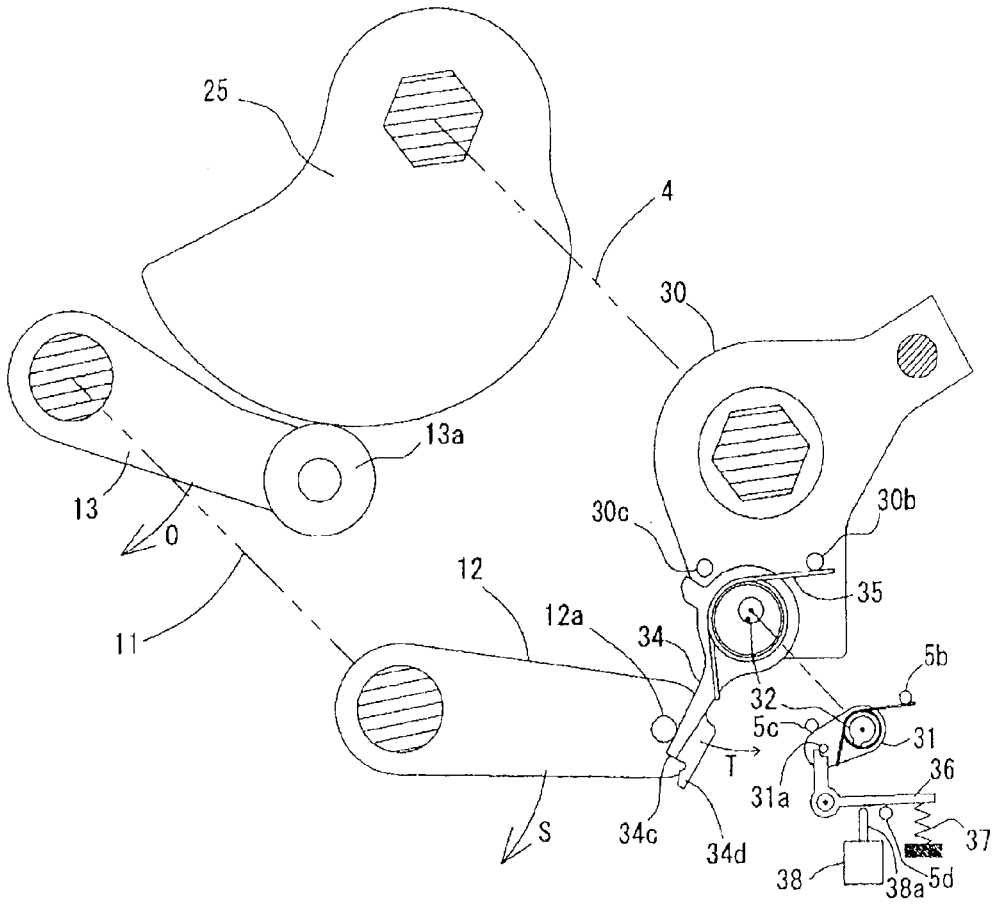
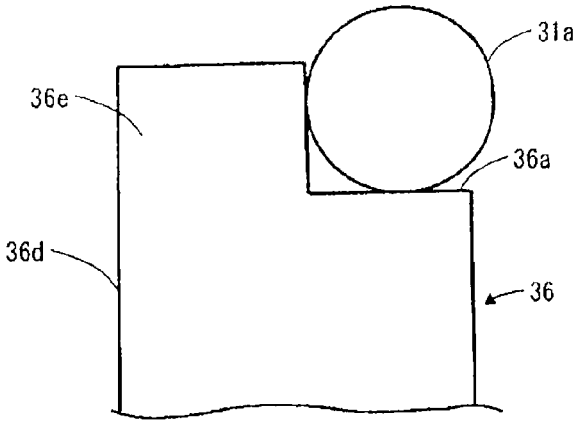
FIG. 10

SWITCHGEAR AND SWITCHGEAR OPERATING MECHANISM

CROSS REFERENCES TO RELATED APPLICATIONS

This application is a continuation-in-part (CIP) application based upon the International Application PCT/JP2011/007350, the International Filing Date of which is Dec. 28, 2011, the entire content of which is incorporated herein by reference, and is based upon and claims the benefits of priority from the prior Japanese Patent Application No. 2011-018481, filed in the Japanese Patent Office on Jan. 31, 2011, the entire content of which is incorporated herein by reference.

FIELD

Embodiments of the present invention relate to a switchgear and a switchgear operating mechanism.

BACKGROUND

In general, there are available, as an operating mechanism of a switchgear, one using a hydraulic operating force for high power and one using a spring operating force for middle/small output power. The former is referred to as "hydraulic operating mechanism" and the latter as "spring operating mechanism". In recent years, the advancement of miniaturization of an arc-extinguishing chamber of a gas circuit breaker which is a type of a switchgear allows fault current to be broken with a smaller operating force, so that application of the spring operating mechanism becomes popular. However, a gas circuit breaker of extra high-voltage class requires high-speed operating capability called "two-cycle cutoff" that is capability of achieving cutoff within a time length corresponding to two-cycle time periods of alternating current. A conventional spring operating mechanism typically has operating capability equivalent to about three-cycle operation, and it is not easy to realize the two-cycle cutoff capability due to poor responsiveness of a retention mechanism or retention control mechanism of a spring force.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which:

FIG. 9 is a front view of the main part of the switchgear of FIG. 1, which illustrates the closing operation continued from FIG. 8;

FIG. 10 is a front view illustrating in an enlarged manner a portion around a leading end of a solenoid lever of FIG. 1;

DETAILED DESCRIPTION

Figure 1:
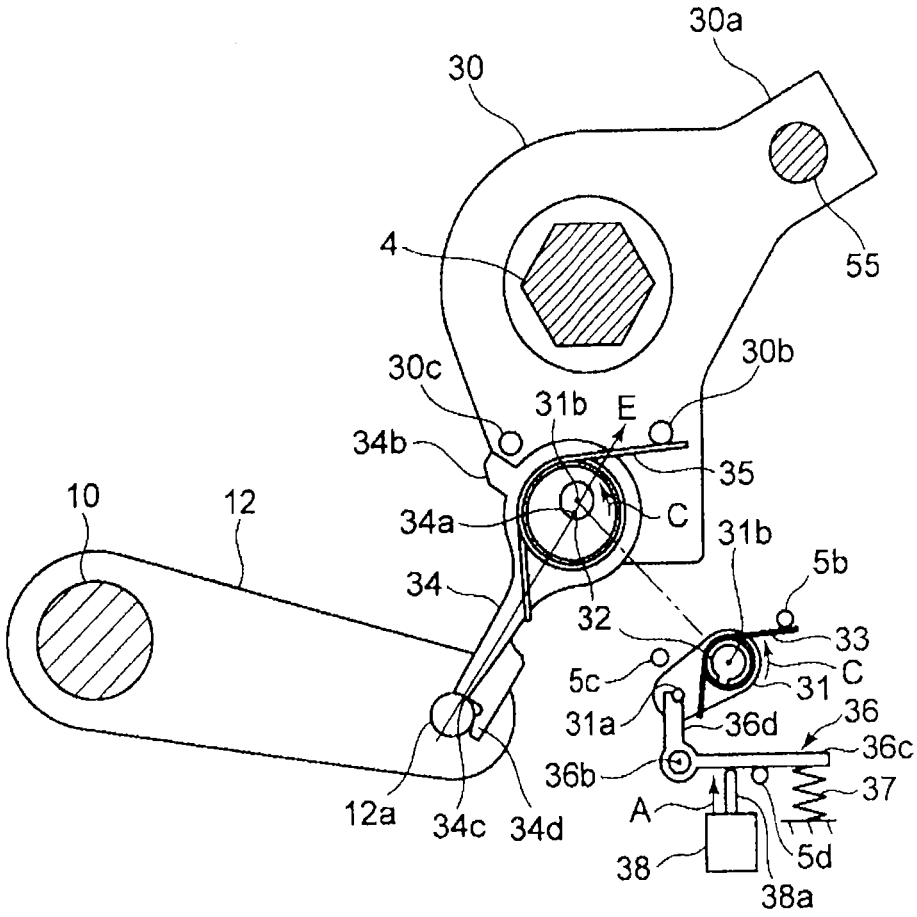
FIG. 1 is a front view illustrating a closed state of a retention unit and a retention control unit of an operating mechanism of a switchgear according to a first embodiment of the present invention.

The embodiments described here have been made to solve the above problem, and an object thereof is to reduce a time period for the cutoff spring force to be released so as to reduce the entire contact opening time period in a switchgear for opening/closing an electrical circuit and its operating mechanism.

According to one embodiment, a switchgear operating mechanism for reciprocatively driving a movable contact of a switchgear so as to shift the switchgear between a cutoff state and a closed state, the operating mechanism including: a frame; a closing shaft rotatably disposed relative to the frame; a main lever fixed to the closing shaft and capable of being swung in conjunction with the movable contact; a cutoff spring disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft disposed so as to be rotatable relative to the frame around a rotation axis substantially parallel to a rotation axis of the closing shaft; a sub-lever swingably fixed to the sub-shaft; a main-sub connection link rotatably connecting a leading end of the sub-lever and the main lever; a cam mechanism swinging the sub-shaft in accordance with the rotation of the closing shaft; a latch lever swingably fixed to the sub-shaft; a latch roller pin rotatably mounted to a leading end of the latch lever; a trigger lever disposed so as to be rotatable relative to the frame around a rotation axis substantially parallel to the rotation axis of the closing shaft; a trigger roller pin rotatably mounted to a leading end of the trigger lever; a trigger lever return spring biasing the trigger lever so as to rotate the trigger lever in a predetermined direction; a latch fixed to the trigger lever at a position different from a rotation axis of the trigger lever so as to be rotatable around a rotation axis substantially parallel to the rotation axis of the closing shaft and having a leading end engageable with the latch roller pin; a latch return spring biasing the latch so as to rotate the latch in a predetermined direction; a solenoid lever disposed relative to the frame so as to be rotatable around a rotation axis substantially parallel to the rotation axis of the closing shaft and having a leading end engageable with the trigger roller pin; a solenoid lever return spring biasing the solenoid lever so as to rotate the solenoid lever in a predetermined direction; and an electromagnetic solenoid for cutoff which acts against a biasing force of the solenoid lever return spring to push the solenoid lever so as to shift the switchgear operating state from the closed state to the cutoff state, wherein in a state where the switchgear operating state is shifted from the closed state to the cutoff state, the solenoid lever is pushed by the electromagnetic solenoid for cutoff so as to be rotated in an opposite direction to the biasing direction of the solenoid lever return spring to release an engagement between the trigger roller pin and the solenoid lever, and the trigger lever and an eccentric pin are rotated by the biasing force of the latch roller pin to release an engagement between the latch roller pin and the leading end of the latch, which causes the cutoff spring to discharge its energy to rotate the latch lever.

According to another embodiment, a switchgear having a movable contact that can be moved in a reciprocating mariner and an operating mechanism that drives the movable contact and configured to be shifted between a cutoff state and a closed state by the movement of movable contact, the operating mechanism including: a frame; a closing shaft rotatably disposed relative to the frame; a main lever fixed to the closing shaft and capable of being swung in conjunction with the movable contact; a cutoff spring disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft disposed so as to be rotatable relative to the frame around a rotation axis substantially parallel to a rotation axis of the closing shaft; a sub-lever swingably fixed to the sub-shaft; a main-sub connection link rotatably connecting a leading end of the sub-lever and the main lever; a cam mechanism swinging the sub-shaft in accordance with the rotation of the closing shaft; a latch lever swingably fixed to the sub-shaft; a latch roller pin rotatably mounted to a leading end of the latch lever; a trigger lever disposed so as to be rotatable relative to the frame around a rotation axis substantially parallel to the rotation axis of the closing shaft; a trigger roller pin rotatably mounted to a leading end of the trigger lever; a trigger lever return spring biasing the trigger lever so as to rotate the trigger lever in a predetermined direction; a latch fixed to the trigger lever at a position different from a rotation axis of the trigger lever so as to be rotatable around a rotation axis substantially parallel to the rotation axis of the closing shaft and having a leading end engageable with the latch roller pin; a latch return spring biasing the latch so as to rotate the latch in a predetermined direction; a solenoid lever disposed relative to the frame so as to be rotatable around a rotation axis substantially parallel to the rotation axis of the closing shaft and having a leading end engageable with the trigger roller pin; a solenoid lever return spring biasing the solenoid lever so as to rotate the solenoid lever in a predetermined direction; and an electromagnetic solenoid for cutoff which acts against a biasing force of the solenoid lever return spring to push the solenoid lever so as to shift the switchgear operating state from the closed state to the cutoff state, wherein in a state where the switchgear operating state is shifted from the closed state to the cutoff state, the solenoid lever is pushed by the electromagnetic solenoid for cutoff so as to be rotated in an opposite direction to the biasing direction of the solenoid lever return spring to release an engagement between the trigger roller pin and the solenoid lever, and the trigger lever and an eccentric pin are rotated by the biasing force of the latch roller pin to release an engagement between the latch roller pin and the leading end of the latch, which causes the cutoff spring to discharge its energy to rotate the latch lever.

Embodiments of an operating mechanism of a switchgear according to the present invention will be described below with reference to the accompanying drawings.

First Embodiment

Figure 2:
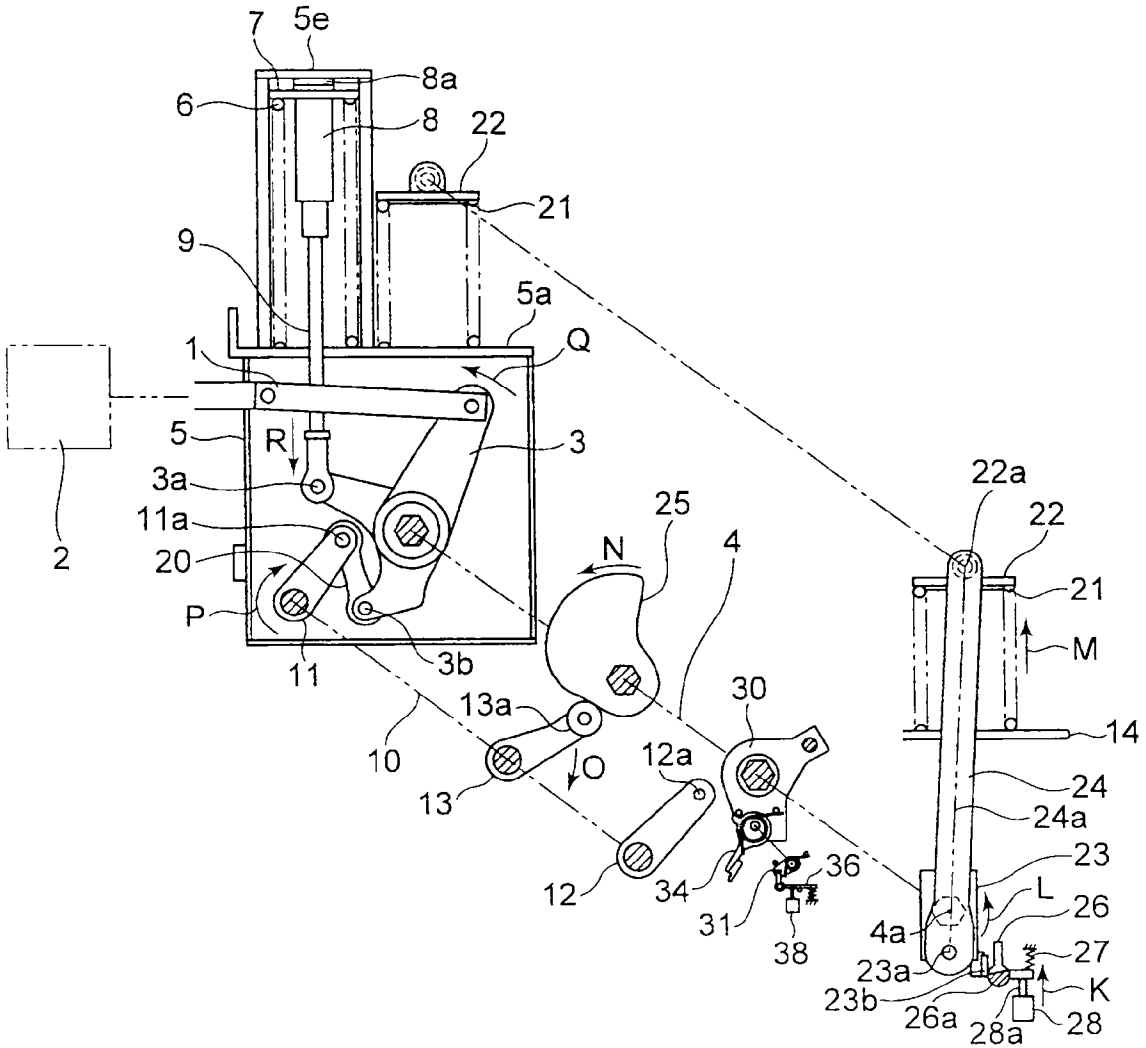
FIG. 2 is a developed front view showing a cutoff state of a spring operating mechanism of the switchgear of FIG. 1.
Figure 3:
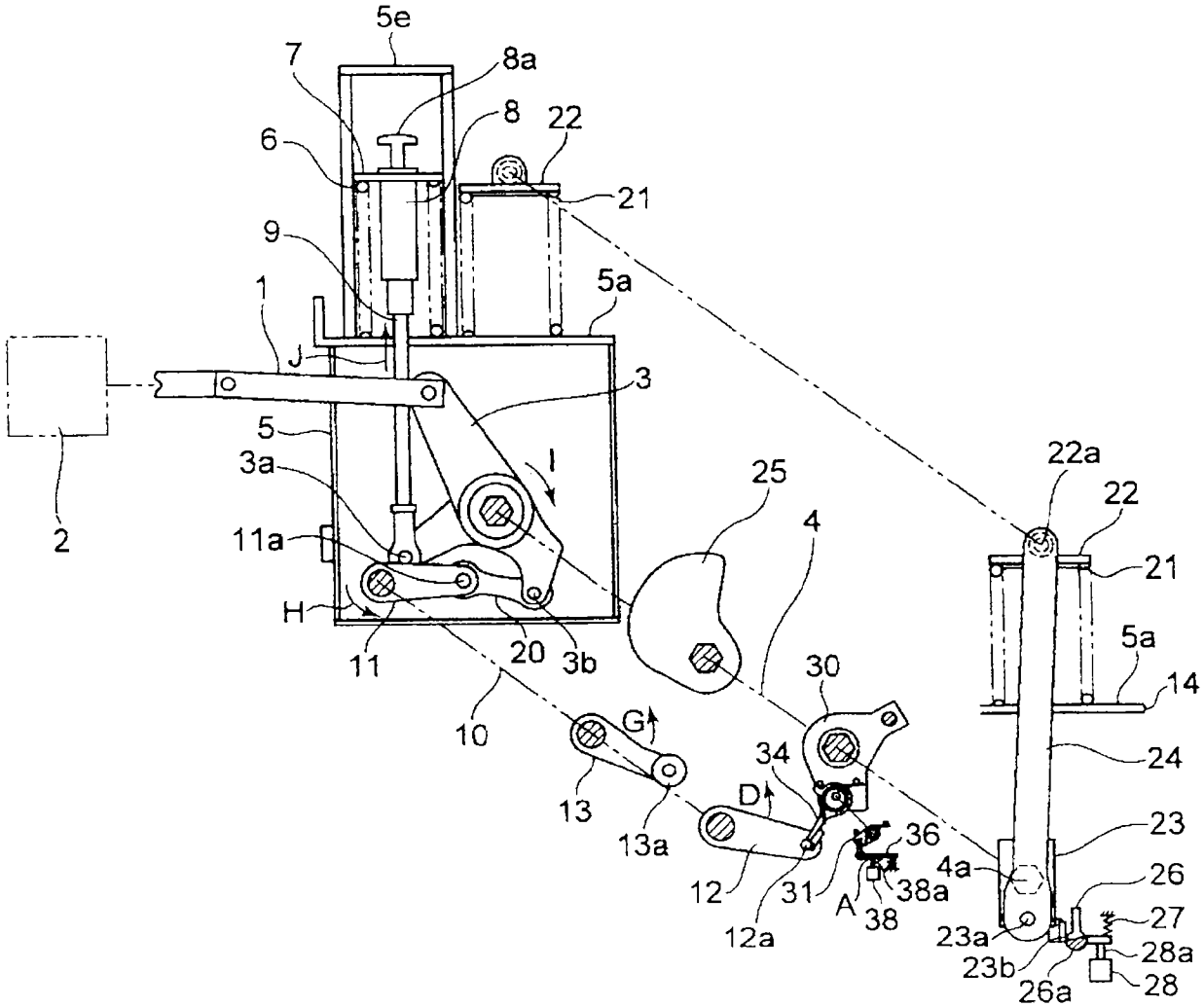
FIG. 3 is a developed front view showing the closed state of the spring operating mechanism of the switchgear of FIG. 1.
Figure 6:
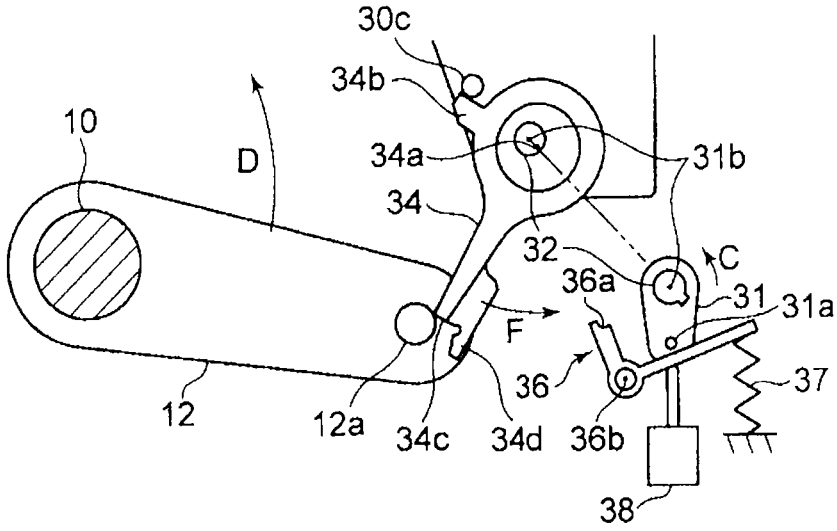
FIG. 6 is a front view of the main part of the switchgear of FIG. 1, which illustrates the cutoff operation continued from FIG. 5.
Figure 7:
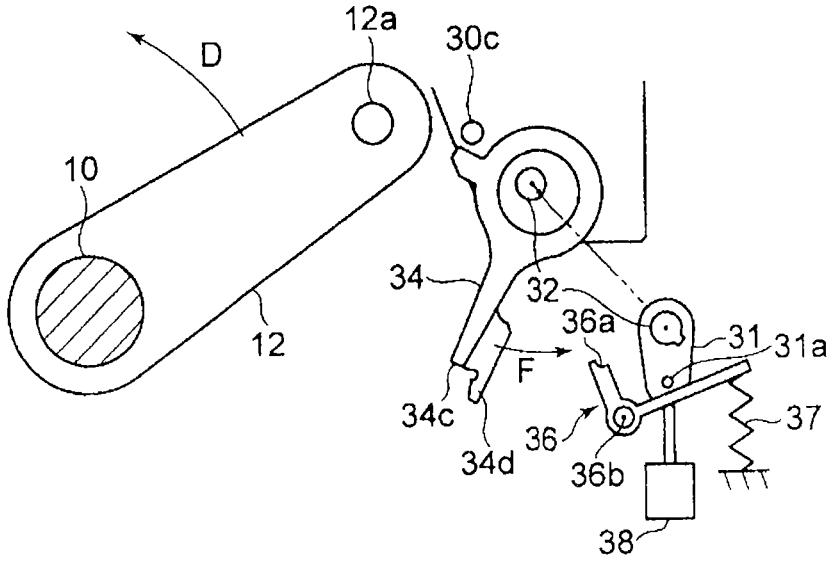
FIG. 7 is a front view of the main part of the switchgear of FIG. 1, which illustrates the cutoff operation continued from FIG. 6.
Figure 8:
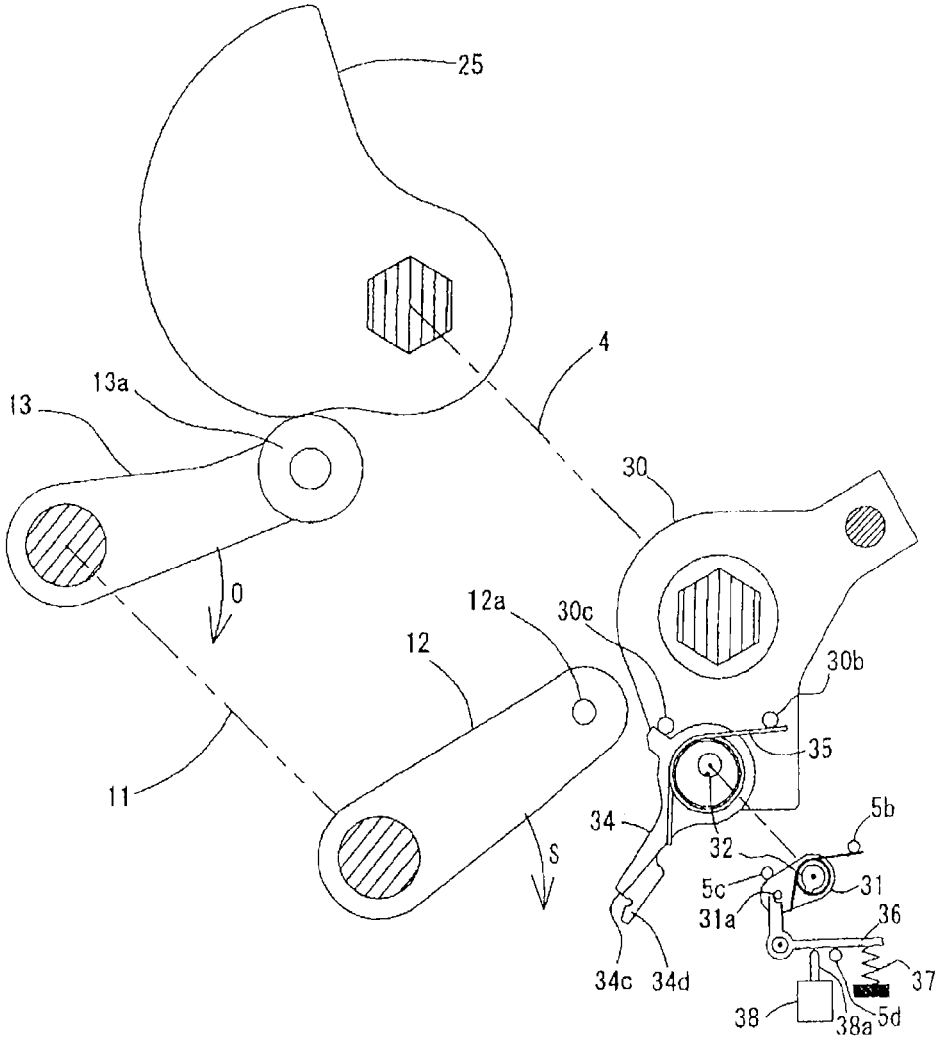
FIG. 8 is a front view of the main part of the switchgear of FIG. 1, which illustrates a state where the closing operation is being performed.

First, with reference to FIGS. 1 to 10, a first embodiment of an operating mechanism of a switchgear according to the present invention will be described. FIG. 1 is a front view illustrating a closed state of a retention unit and a retention control unit of an operating mechanism of a switchgear. FIG. 2 is a view illustrating a cutoff state of a spring operating mechanism including the units illustrated in FIG. 1. FIG. 3 is a view illustrating a closed state of the spring operating mechanism including the units illustrated in FIG. 1. FIGS. 4 to 7 are views illustrating a state where an operation state is being shifted from the closed state to cutoff state by the cutoff operation. FIGS. 8 and 9 are views illustrating a state where the operation state is shifted from the cutoff state to closed state by the closing operation. FIG. 10 is a front view illustrating in an enlarged manner a portion around a leading end of a solenoid lever of FIG. 1.

In FIGS. 2 and 3, a movable contact 2 is connected to a left side of a link mechanism 1. When the link mechanism 1 is moved in a right direction as illustrated in FIG. 2, the movable contact 2 becomes "open" to achieve a cutoff state. On the other hand, when the link mechanism 1 is moved in a left direction as illustrated in FIG. 3, the movable contact 2 becomes "closed" to achieve a closed state. One end of the link mechanism 1 is rotatably engaged with a leading end of a main lever 3, and the main lever 3 is rotatably fixed to a closing shaft 4. The closing shaft 4 is rotatably supported by a bearing (not illustrated) fixed to a frame (support structure) 5.

A cutoff spring 6 has one end fixed to an attachment surface 5*a* of the frame 5 and the other end fitted to a cutoff spring receiver 7. A damper 8 is fixed to the cutoff spring receiver 7. In the damper 8, a fluid is encapsulated and a piston 8*a* is provided so as to translationally slide. One end of the damper 8 is fixed to a cutoff spring link 9, which is rotatably attached to a pin 3*a* of the main lever 3.

A sub-shaft 10 is rotatably disposed relative to the frame 5, and a sub-lever 11 is fixed to the sub-shaft 10. A pin 11*a* is disposed at a leading end of the sub-lever 11. A pin 3*b* disposed in the main lever 3 and the pin 11*a* are connected by a main-sub connection link 20. A latch lever 12 is fixed to the sub-shaft 10, and a latch roller pin 12*a* is rotatably fitted to a leading end of the latch lever 12. Further, a cam lever 13 is fixed to the sub-shaft 10, and a cam roller 13*a* is rotatably fitted to a leading end of the cam lever 13.

A closing spring 21 has one end fixed to the attachment surface 5*a* of the frame 5 and the other end fixed to a closing spring receiver 22. A pin 22*a* is disposed in the closing spring receiver 22. The pin 22*a* is connected to a pin 23*a* of a closing lever 23 which is fixed to an end portion of the closing shaft 4 through a closing link 24. A closing cam 25 is fixed to the closing shaft 4 and releasably engaged with the cam roller 13*a* in accordance with rotation of the closing shaft 4.

A tab 23*b* is disposed at one end of the closing lever 23 and is releasably engaged with a half-column portion 26*a* provided in an anchoring lever 26 for closing which is rotatably disposed relative to the frame 5. Further, a return spring 27 is disposed at one end of the anchoring lever 26 for closing. The other end of the return spring 27 is fixed to the frame 5. The return spring 27 is a compression spring and spring force thereof always acts on the anchoring lever 26 for closing as a clockwise torque. However, the rotation of the anchoring lever 26 for closing is restricted by an engagement between a plunger 28*a* of an electromagnetic solenoid 28 for closing which is fixed to the frame 5 and the anchoring lever 26 for closing.

In a cutoff state illustrated in FIG. 2, a rotation axis center 4*a* of the closing shaft 4 is displaced to the left relative to a center axis 24*a* (axis connecting the centers of the pin 22*a* and the pin 23*a*) of the closing link 24, so that a counterclockwise torque is applied to the closing lever 23 by the closing spring 21. However, the rotation of the closing lever 23 is retained by an engagement between the tab 23*b* and the half-column portion 26*a*.

As illustrated in FIG. 1, the anchoring lever 30 has a protruding support portion 30*a*. The protruding support portion 30*a* is engaged with a pin 55 fixed to the frame 5, which fixes a position of the anchoring lever 30 to the frame 5.

A trigger lever 31 is fixed to an eccentric pin 32 rotatably disposed relative to an end portion of the anchoring lever 30, and a trigger roller pin 31*a* is rotatably fitted to a leading end of the trigger lever 31. A trigger lever return spring 33 is disposed between the frame 5 and the trigger lever 31. An end portion of the trigger lever return spring 33 is engaged with a pin 5*b* fixed to the frame 5. The trigger lever return spring 33 always generates a clockwise torque for the trigger lever 31. The clockwise rotation of the trigger lever return spring 33 is restricted by an abutment between a stopper pin 5*c* disposed on the frame 5 and the trigger lever 31.

A latch 34 is rotatably disposed around the eccentric pin 32 so as to have a rotation axis center 34*a* at a position eccentric from a rotation axis center 31*b* of the trigger lever 31. The latch 34 has a protrusion 34*b*. A latch return spring 35 is disposed between the anchoring lever 30 and the latch 34. An end portion of the latch return spring 35 is engaged with a pin 30*b* fixed to the anchoring lever 30. The latch return spring 35 always generates a clockwise torque for the latch 34. The clockwise rotation of the latch 34 is restricted by an abutment between a stopper pin 30*c* disposed on the anchoring lever 30 and the protrusion 34*b* of the latch 34. A leading end 34*c* of the latch 34 is formed by a plane normal to a line connecting a rotation axis center of the latch roller pin 12*a*, the rotation axis center 34*a* of the latch 34 and a rotation axis center 36*b* of a solenoid lever 36.

The latch 34 has a leading end protrusion 34*d* which protrudes from a one side surface of the leading end 34*c*. In a closed state illustrated in FIGS. 1 and 3, a side surface of the leading end protrusion 34*d* pushes a side surface of the latch roller pin 12*a* at one side surface at which the leading end 34*c* of the latch and the latch roller pin 12*a* are engaged with each other by the clockwise torque of the latch return spring 35 for the latch 34.

The solenoid lever 36 is configure to be rotatable around the rotation axis center 36*b* fixed to the frame 5 and has a first side 36*c* extending in one direction from the rotation axis center 36*b* and a second side 36*d* extending in a direction perpendicular to the first side 36*c* from the rotation axis center 36*b*. A solenoid lever return spring 37 is disposed at one end of the first side 36*c* of the solenoid lever 36, and the other end of the solenoid lever return spring 37 is fixed to the frame 5. The solenoid lever return spring 37 is a tension spring, and a spring force that rotates the solenoid lever 36 in the clockwise direction is always applied to the solenoid lever 36. However, the rotation of the solenoid lever 36 is restricted by an engagement between a stopper pin 5*d* fixed to the frame 5 and the first side 36*c* of the solenoid lever 36.

As illustrated in FIG. 10, a solenoid lever leading end protrusion 36*e* protruding from one side surface of a solenoid lever leading end 36*a* of the second side 36*d* of the solenoid lever 36 has a plane normal to a line connecting a rotation axis center of the trigger roller pin 31*a* and the rotation axis center 36*b* of the solenoid lever.

A leading end of a plunger 38*a* of an electromagnetic solenoid 38 for cutoff which is fixed to the frame 5 is releasably engaged with the solenoid lever 36, which causes the solenoid lever 36 to be rotated in the counterclockwise direction upon input of an cutoff command.

In the closed state illustrated in FIGS. 1 and 3, the leading end 34*c* of the latch 34 is engaged with the latch roller pin 12*a*, and the latch roller pin 12*a* pushes the leading end 34*c* of the latch 34 toward the rotation axis center 34*a* of the latch 34 (direction denoted by an arrow E). At this time, the rotation axis center 31*b* of the trigger lever 31 is disposed from a line connecting a center of the latch roller pin 12*a* and the rotation axis center 34*a* of the latch 34 or an extended line thereof toward the sub-shaft 10 side, so that a counterclockwise torque is applied to the trigger lever 31 and the eccentric pin 32. However, the rotation of the trigger lever 31 is restricted by an engagement between the trigger roller pin 31*a* and the leading end 36*a* of the solenoid lever 36. Further, the trigger roller pin 31*a* pushes the leading end 36*a* of the solenoid lever 36 toward the rotation axis center 36*b* of the solenoid lever 36 so as to be able to stop counterclockwise rotation of the solenoid lever 36.

In the closed state, the main lever 3 always receives a clockwise torque by a tensile spring force of the cutoff spring 6. The force transmitted to the main lever 3 is then transmitted to the sub-lever 11 through the main-sub connection link 20. The transmitted force becomes a torque for always rotating the sub-lever 11 in the counterclockwise direction. This counterclockwise torque is supplied also to the latch lever 12.

However, in the closed state, the leading end 34*c* of the latch 34 and the latch roller pin 12*a* are engaged with each other to restrict the counterclockwise rotation of the latch lever 12. Accordingly, the subsequent members from the sub-lever 11 to the cutoff spring 6 maintain their static state.

In the present embodiment, the rotation shafts, such as the closing shaft 4 and the sub-shaft 10, and axes of the respective pins are parallel to each other and are normal to the paper surfaces of FIGS. 1 to 10.

(Cutoff Operation)

In the present embodiment having the configuration described above, a cutoff operation causing the operation state to be shifted from the closed state illustrated in FIGS. 1 and 3, through states illustrated in FIGS. 4 to 7, to the cutoff state illustrated in FIG. 2 will be described.

First, in the closed state illustrated in FIGS. 1 and 3, upon input of an external command, the electromagnetic solenoid 38 for cutoff is excited to move the plunger 38*a* in a direction denoted by an arrow A.

Since the solenoid lever 36 is engaged with the plunger 38*a*, it is rotated in the counterclockwise direction (direction denoted by an arrow B) to release the engagement between the leading end 36*a* of the solenoid lever 36 and the trigger roller pin 31*a*, thereby rotating the trigger lever 31 and the eccentric pin 32 in the counterclockwise direction (direction denoted by an arrow C). Then, the latch 34 starts to swing while maintaining the engagement state between the leading end 34*c* of the latch 34 and the latch roller pin 12*a*, and the latch lever 12 receives the counterclockwise (direction denoted by an arrow D) torque from the cutoff spring 6 to be rotated in the counterclockwise direction. This state is illustrated in FIG. 4.

At this time, the latch roller pin 12*a* pushes the leading end 34*c* of the latch 34 toward the rotation axis center 34*a* (direction denoted by an arrow E) of the latch 34, and the rotation axis center 31*b* of the trigger lever 31 is disposed to the sub-shaft 10 side relative to the arrow E. Thus, a counterclockwise (direction denoted by the arrow C) torque is applied to the eccentric pin 32 and the trigger lever 31.

Figure 4:
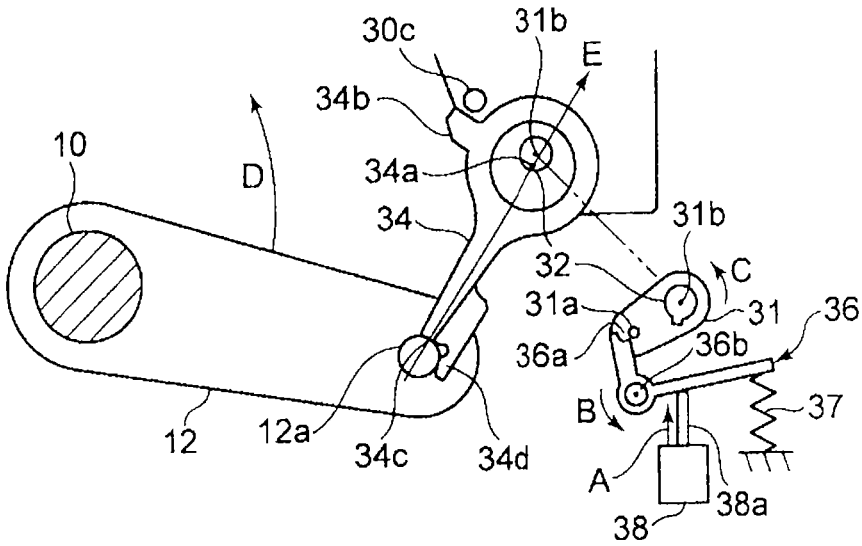
FIG. 4 is a front view of a main part of the switchgear of FIG. 1, which illustrates a state where the cutoff operation is being performed.

After the state illustrated in FIG. 4, the latch lever 12 is further rotated in the counterclockwise direction (direction denoted by the arrow D). Further, the eccentric pin 32 and the trigger lever 31 are further rotated in the counterclockwise direction (direction denoted by the arrow C) to bring the protrusion 34*b* of the latch 34 and the stopper pin 30*c* into contact with each other. This state is illustrated in FIG. 5.

Figure 5:
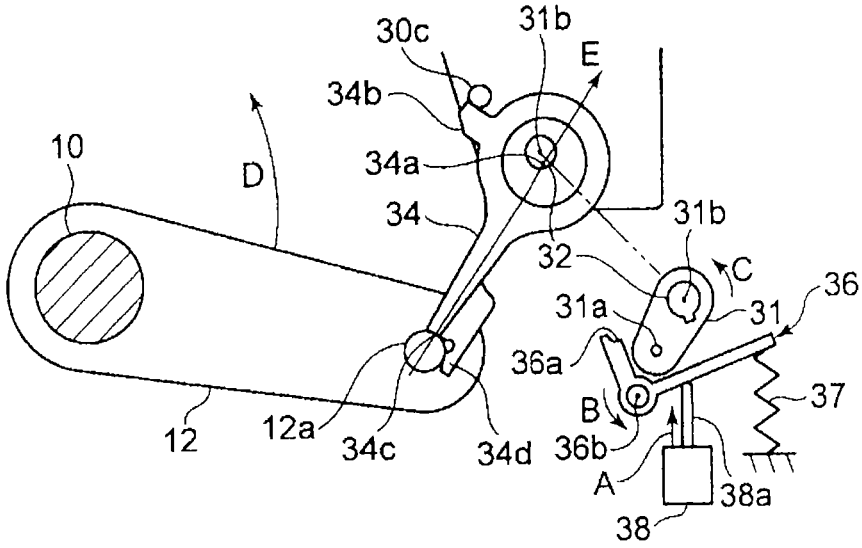
FIG. 5 is a front view of the main part of the switchgear of FIG. 1, which illustrates the cutoff operation continued from FIG. 4.

After the state illustrated in FIG. 5, the latch lever 12 is further rotated in the counterclockwise direction (direction denoted by the arrow D). Further, the eccentric pin 32 and the trigger lever 31 are further rotated in the counterclockwise direction (direction denoted by the arrow C). At the same time, the latch 34 is rotated in the counterclockwise direction (direction denoted by an arrow F') while contacting the stopper pin 30*c*. This state is illustrated in FIG. 6. As a result, the engagement between the leading end 34*c* of the latch 34 and the latch roller pin 12*a* is released.

After the state illustrated in FIG. 6, the latch lever 12 is further rotated in the counterclockwise direction (direction denoted by the arrow D) while pushing away the latch 34. This state is illustrated in FIG. 7.

FIG. 2 illustrates an end state of the cutoff operation. In this state, the latch 34 has been returned to substantially the same position as that in the closed state (FIGS. 1 and 3) by the latch return spring 35 (FIG. 1). Further, trigger lever 31 has been returned to substantially the same position as that in the closed state (FIGS. 1 and 3) by the trigger lever return spring 33 (FIG. 1). Furthermore, the solenoid lever 36 has been returned to substantially the same position as that in the closed state (FIGS. 1 and 3) by the solenoid lever return spring 37 (FIG. 1).

When the engagement between the latch 34 and the latch roller pin 12*a* is released in the closed state illustrated in FIG. 3, the cam lever 13 and the sub-lever 11, which are fixed to the latch lever 12 and the sub-shaft 10, are rotated in the counterclockwise direction (direction denoted by arrows G and H). Then, the main lever 3 is rotated in the clockwise direction (direction denoted by an arrow I) to cause the cutoff spring 6 and the damper 8 to be moved in a direction denoted by an arrow J. Then, the link mechanism 1 and the movable contact 2 connected to the link mechanism 1 are moved to the right to start the cutoff operation.

When the cutoff spring 6 is displaced by a given distance, the piston 8*a* abuts against the stopper 5*e* fixed to the frame 5 to generate a braking power of the damper 8 to thereby stop the movement of the cutoff spring 6. The movements of the link levers connected to the cutoff spring 6 are accordingly stopped, thereby completing the cutoff operation. This state is illustrated in FIG. 2.

(Closing Operation)

Next, a cutoff operation causing the operation state to be shifted from the cutoff state illustrated in FIG. 2, through states illustrated in FIGS. 8 and 9, to the closing state illustrated in FIGS. 1 and 3 will be described.

FIG. 2 illustrates a state where the closing spring 21 is compressed to accumulate energy in the cutoff state. Upon input of an external command, the electromagnetic solenoid 28 for closing is excited to move the plunger 28*a* in the direction denoted by an arrow K. At this time, the anchoring lever 26 for closing is engaged with the plunger 28*a*, so that it is rotated in the counterclockwise direction. Then, the engagement between the half-column portion 26*a* and the tab 23*b* is released. Accordingly, the closing lever 23 and the closing shaft 4 are rotated in the counterclockwise direction (direction denoted by an arrow L) by a spring force of the closing spring 21. The closing spring 21 is stretched in a direction denoted by an arrow M and discharges its accumulated energy. The closing cam 25 fixed to the closing shaft 4 is rotated in a direction denoted by an arrow N to be engaged with the cam roller 13*a*. When the cam roller 13*a* is pushed by the closing cam 25, the cam lever 13 is rotated in the clockwise direction (direction denoted by an arrow O) and, at the same time, the sub-lever 11 is rotated in a direction denoted by an arrow P.

The rotation of the sub-lever 11 is transmitted to the main lever 3 and, accordingly, the main lever 3 is rotated in the counterclockwise direction (direction denoted by an arrow Q). Then, the link mechanism 1 and the movable contact 2 connected to the link mechanism 1 are moved to the left to start the closing operation. In association with the rotation of the main lever 3, the cutoff spring link 9 is moved in a direction denoted by an arrow R, with the result that the cutoff spring 6 is compressed to accumulate energy.

In the closing operation, the cam lever 13 is rotated in the clockwise direction (direction denoted by the arrow O) in a state where the operation is shifted from the cutoff state illustrated in FIG. 2, and the latch lever 12 fixed to the cam lever 13 and the sub-shaft 10 is rotated also in the clockwise direction (direction denoted by an arrow S). This state is illustrated in FIG. 8.

After the state illustrated in FIG. 8, the latch 34 is rotated in the counterclockwise direction (direction denoted by an arrow T) by the latch roller pin 12*a*. This state is illustrated in FIG. 9.

When the engagement between the closing cam 25 and the cam roller 13*a* is released, the latch roller pin 12*a* is returned to its closed-state position by a stretching force of the cutoff spring 6. Further, when the engagement between the latch roller pin 12*a* and the latch 34 is released, the latch 34 is returned to its closed state-position by a biasing force of the latch return spring 35, with the result that the leading end 34*c* of the latch 34 and the latch roller pin 12*a* are reengaged with each other (FIGS. 1 and 3).

At this reengagement operation, the latch roller pin 12*a* pushes the leading end 34*c* of the latch 34 toward the rotation axis center 34*a* of the latch 34 (direction denoted by the arrow E), so that the trigger lever 31 and the eccentric pin 32 are ready to be rotated in the counterclockwise direction (direction denoted by the arrow C). However, the rotation of the trigger lever 31 is restricted by the engagement between the trigger roller pin 31*a* and the leading end 36*a* of the solenoid lever 36. Further, the trigger roller pin 31*a* pushes the leading end 36*a* of the solenoid lever 36 toward the rotation axis center 36*b* of the solenoid lever 36 to restrict the counterclockwise rotation of the solenoid lever 36, and the movements of the link levers are accordingly stopped, thereby completing the cutoff operation. This state is illustrated in FIGS. 1 and 3.

According to the present embodiment, after the electromagnetic solenoid 38 for cutoff is excited upon input of a cutoff command, the cutoff operation is completed by two operation steps: a first operation step in which the latch 34 is directly driven through the solenoid lever 36 and the eccentric pin 32 to release the engagement between the latch 34 and the latch roller pin 12*a*; and a second operation step in which the cutoff spring 6 operates. As described above, the number of operation steps for completing the cutoff operation is reduced from three (in the case of conventional spring operating mechanism) to two, thereby significantly reducing the cutoff operation time period. This means that T2 is removed from the expression (1) representing the contact opening time period, so that it is possible to reduce the contact opening time period.

Further, the counterclockwise (direction denoted by the arrow C) torque is always applied to the eccentric pin 32 during a time from input of the cutoff command to the release of the engagement between the leading end 34*c* of the latch 34 and the latch roller pin 12*a*, thereby enabling further reduction in the contact opening time period.

Further, the latch 34 is not directly driven by the electromagnetic solenoid 38 for cutoff, so that influence of a restoring force of the latch return spring 35 on the contact opening time period is small. Thus, an increase in the restoring force of the latch return spring 35 allows acceleration of return of the latch 34 at the time of the closing operation without prolonging the contact opening time period, thereby allowing stability of the closing operation to be increased.

Further, the solenoid lever 36 retaining the restoring force of the cutoff spring 6 stays at a position where it should be situated at the closing operation completion time, thereby allowing stability of the closing operation to be increased.

Further, the engagement surface of the leading end 36*a* of the solenoid lever 36 is formed by a plane, and the trigger roller pin 31*a* pushes the leading end 36*a* of the solenoid lever 36 toward the rotation axis center 36*b* of the solenoid lever 36 at the time of the closing operation, so that no torque is applied from the trigger roller pin 31*a* to the solenoid lever 36 in the closed state. This allows a reduction in a size of the solenoid lever 36 to thereby minimize a force required for pulling out the solenoid lever 36, which in turn can minimize a size of the electromagnetic solenoid 38 for cutoff.

Further, the number of components is reduced as compared to the conventional example, material cost and the number of assembling steps can significantly be reduced.

According to the first embodiment described above, in the switchgear for opening/closing an electrical circuit and its operating mechanism, retention and release of a cutoff spring force is performed by a combination of a latch and its malfunction preventing mechanism. With this configuration, it is possible to reduce the time required for releasing the cutoff spring force to thereby reduce the entire contact opening time period. At the same time, stability and reliability of a retention state of the cutoff spring force can be improved.

Second Embodiment

Figure 11:
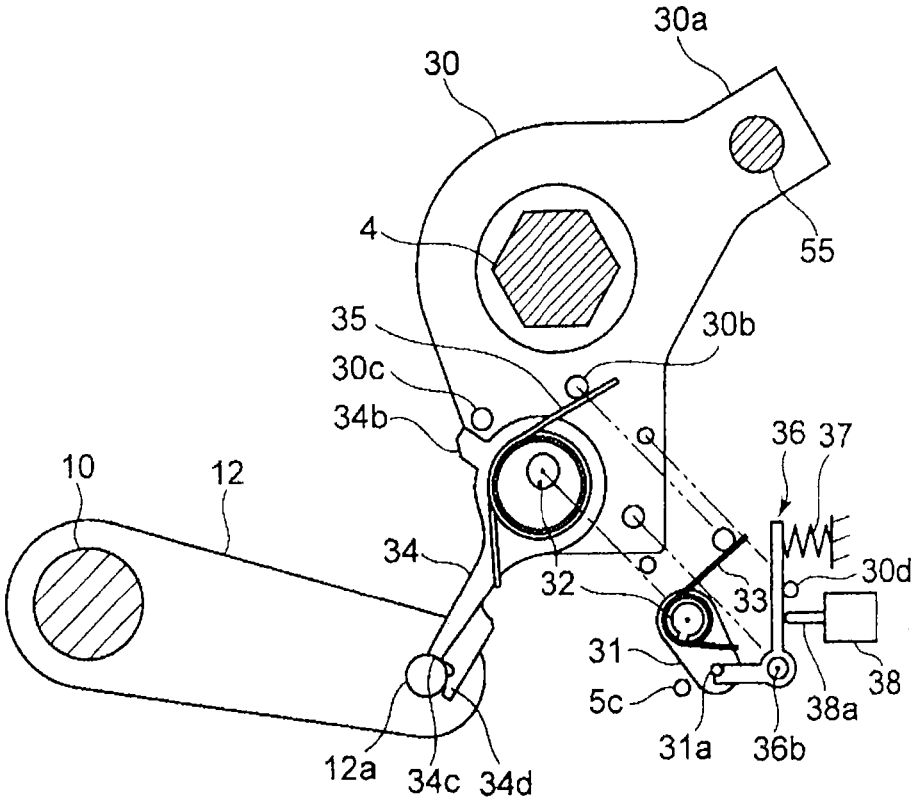
FIG. 11 is a front view illustrating the closed state of a retention unit of an operating mechanism of a switchgear according to a second embodiment of the present invention.

FIG. 11 is a front view illustrating a main part of the latch and a solenoid lever of an operating mechanism of a switchgear according to a second embodiment of the present invention and their surrounding portion. The same reference numerals are given to the same or similar parts to the first embodiment, and the repeated description will be omitted.

In the present embodiment, the solenoid lever 36 is rotatably disposed relative to the anchoring lever 30. The solenoid lever return spring 37 is a tension spring and the spring force thereof always acts on the solenoid lever 36 as a clockwise torque. However, the rotation of the solenoid lever 36 is restricted by an engagement between a stopper pin 30*d* fixed to the anchoring lever 30 and the solenoid lever 36. Further, an end portion of the trigger lever return spring 33 is engaged with the pin 30*b* fixed to the anchoring lever 30.

In the present embodiment having the configuration as described above, the solenoid lever 36 can be disposed on the anchoring lever 30 like the latch 34 and the trigger lever 31, so that error in a positional relationship between the components can be reduced.

Third Embodiment

Figure 12:
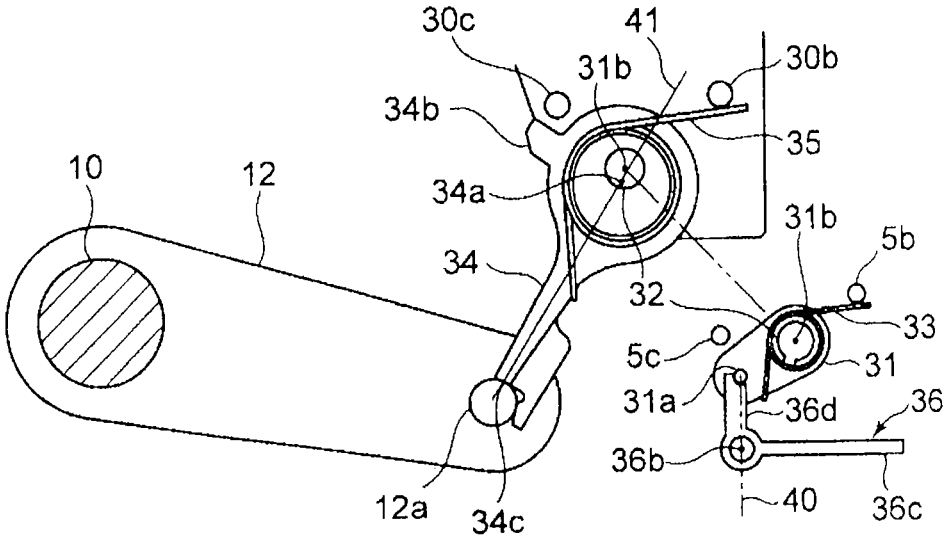
FIG. 12 is a front view illustrating the closed state of a retention unit of an operating mechanism of a switchgear according to a third embodiment of the present invention.
Figure 13:
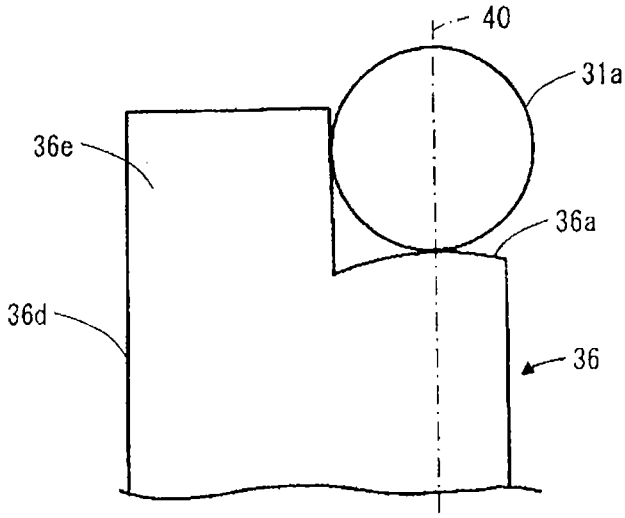
FIG. 13 is a front view illustrating in an enlarged manner a portion around a leading end of a solenoid lever of FIG. 12.
Figure 14:
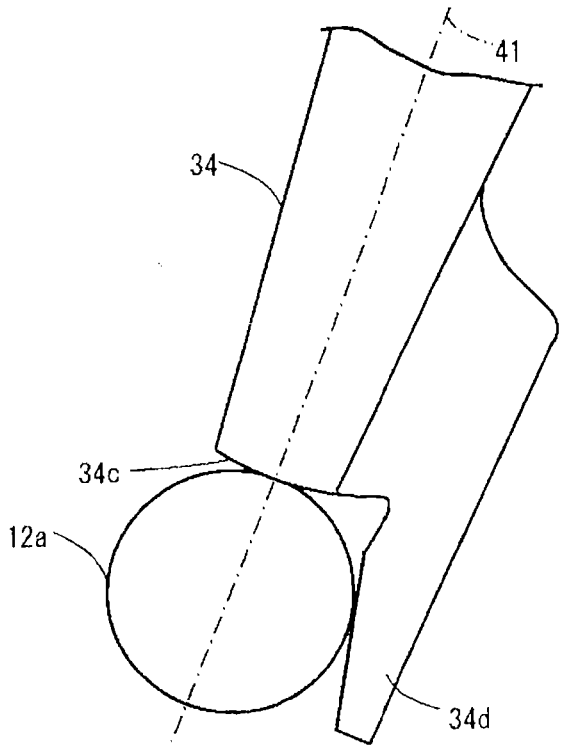
FIG. 14 is a front view illustrating in an enlarged manner a portion around a leading end of a latch of FIG. 12.

FIG. 12 is a front view illustrating a main part of the latch and a solenoid lever of an operating mechanism of a switchgear according to a third embodiment of the present invention and their surrounding portion. FIG. 13 is a front view illustrating in an enlarged manner a portion around a leading end of the solenoid lever of FIG. 12. FIG. 14 is a front view illustrating in an enlarged manner a portion around a leading end of the latch of FIG. 12. The same reference numerals are given to the same or similar parts to the first embodiment, and the repeated description will be omitted.

As illustrated in FIG. 13, in the present embodiment, the leading end 36*a* of the solenoid lever 36 is formed to have a convex circular-arc surface (i.e., convex cylindrical surface), and a center of the circular-arc surface is made to be substantially located on a line 40 connecting the rotation axis center of the trigger roller pin 31*a* in the closed state and the rotation axis center 36*b* of the solenoid lever 36. As a result, a force required for releasing the engagement between the trigger roller pin 31*a* and the leading end 36*a* of the solenoid lever 36 at the start time of the cutoff operation is further reduced, allowing a reduction in the size of the electromagnetic solenoid and a reduction in the contact opening time period.

Further, as illustrated in FIG. 14, the leading end 34*c* of the latch 34 is formed to have a convex circular-arc surface (i.e., convex cylindrical surface), and a center of the circular-arc surface is made to be substantially located on a line 41 connecting the rotation axis center of the latch roller pin 12*a* in the closed state and the rotation axis center 34*a* of the latch 34. As a result, a time required for releasing the engagement between the latch 34 and the latch roller pin 12*a* is reduced, allowing a reduction in the contact opening time period.

Fourth Embodiment

Figure 15:
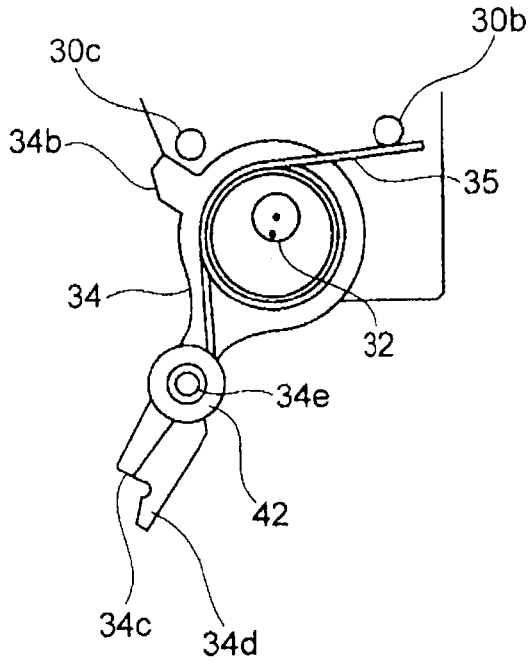
FIG. 15 is a front view illustrating the closed state of a retention unit of an operating mechanism of a switchgear according to a fourth embodiment of the present invention.

FIG. 15 is a front view illustrating a main part of the latch of an operating mechanism of a switchgear according to a fourth embodiment of the present invention and its surrounding portion. The same reference numerals are given to the same or similar parts to the first embodiment, and the repeated description will be omitted.

In the present embodiment, a latch pin 34*e* is disposed on the latch 34, and a ring 42 is on the latch pin 34*e* so as to be movable in a radial direction of the latch pin 34*e*. An inner diameter of the ring 42 is larger than an outer diameter of the latch pin 34*e*.

Figure 16:
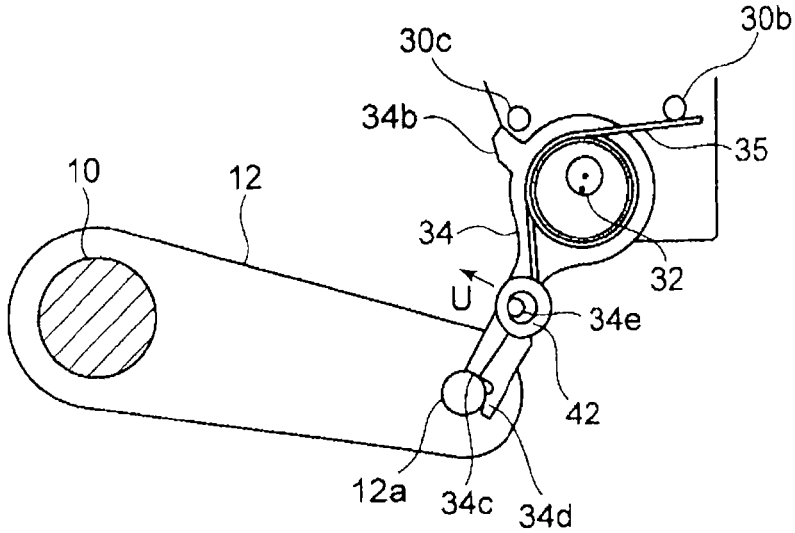
FIG. 16 is a front view of the main part of the switchgear of FIG. 15, which illustrates a state immediately before completion of the closing operation.
Figure 17:
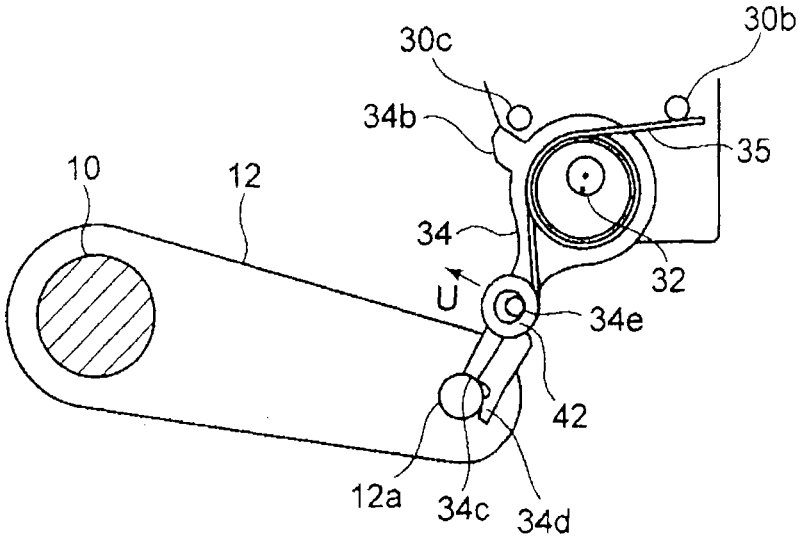
FIG. 17 is a front view of the main part of the switchgear of FIG. 15, which illustrates a state continued from FIG. 16.

A state immediately before completion of the closing operation of the present embodiment having the above configuration is illustrated in FIGS. 16 and 17.

When the latch 34 is returned to its closed-state position by the latch return spring 35, the leading end protrusion 34*d* of the latch 34 collides with the latch roller pin 12*a* and bounces off, so that the latch 34 is not stopped at its closed-state position but is rotated in the counterclockwise direction, which may release the engagement between the leading end 34*c* of the latch 34 and the latch roller pin 12*a* to cause malfunction.

However, in the present embodiment, when the leading end protrusion 34*d* of the latch 34 and the latch roller pin 12*a* collide with each other, the ring 42 is moved in a direction denoted by an arrow U (FIG. 16) opposite to the bouncing direction of the latch 34 by an inertial force to collide with the latch pin 34*e* (FIG. 17). This can prevent the counterclockwise rotation of the latch 34 and serves as the malfunction preventing mechanism for the latch 34.

According to the present embodiment, coming off of the latch 34 which may caused when the leading end protrusion 34*d* of the latch 34 and the latch roller pin 12*a* collide with each other in the closing operation is prevented by means of the ring 42, thereby increasing operational reliability of the spring operating mechanism.

Further, the mounting position of the ring 42 is not limited to the position illustrated in FIG. 15 and the same effect can be obtained when the ring 42 is disposed at any position on the latch 34.

Further, by designing the ring 42 to be formed of metal having high hardness and high density, a high-polymer material having high elasticity, or a complex thereof, it is possible to enhance the effect of preventing coming off of the latch 34.

Fifth Embodiment

Figure 18:
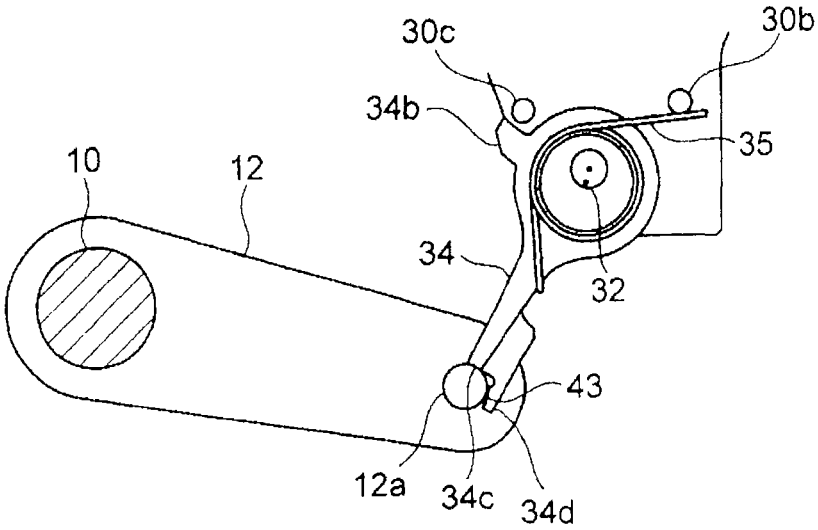
FIG. 18 is a front view illustrating the closed state of a retention unit of an operating mechanism of a switchgear according to a fifth embodiment of the present invention.
Figure 19:
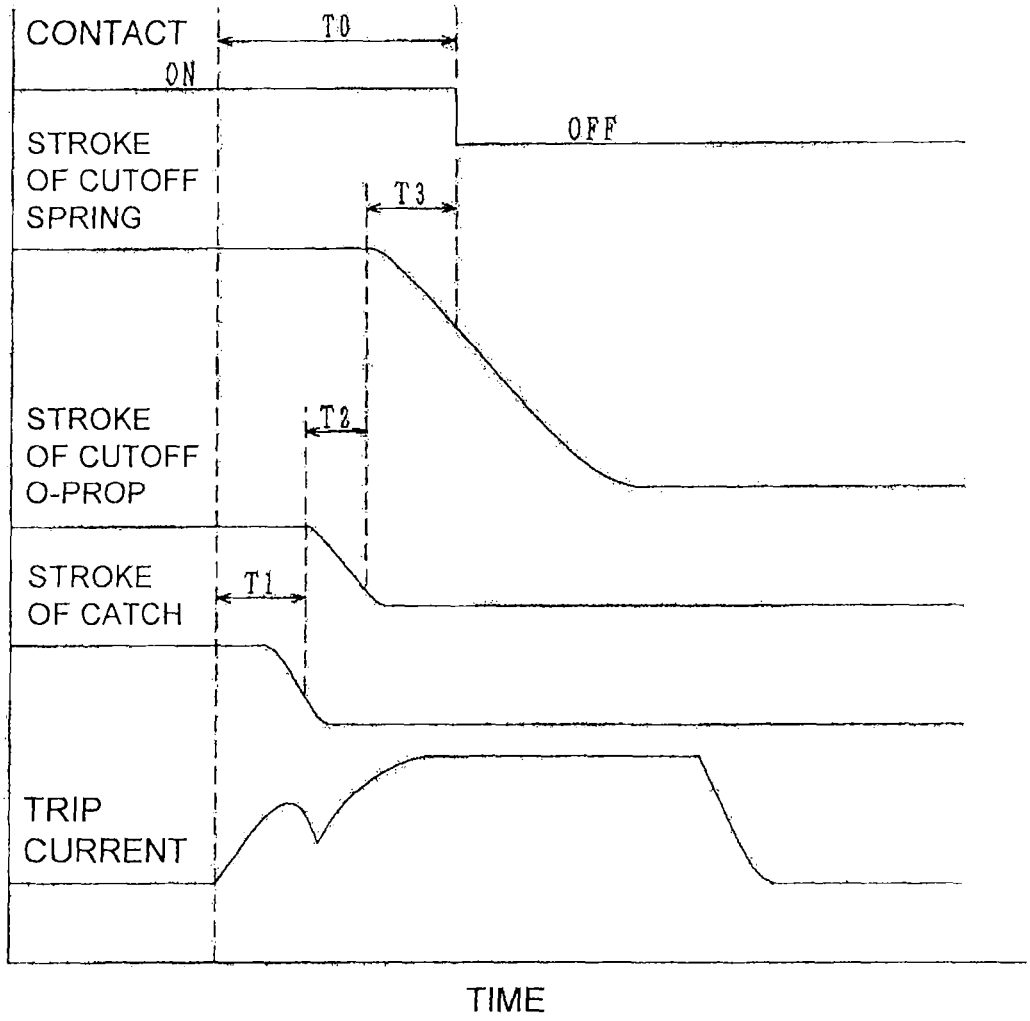
FIG. 19 is a time chart for explaining the cutoff operation of a conventional switchgear.

FIG. 18 is a front view illustrating a main part of the latch and a solenoid lever of an operating mechanism of a switchgear according to a fifth embodiment of the present invention and their surrounding portion. The same reference numerals are given to the same or similar parts to the first embodiment, and the repeated description will be omitted. In the present embodiment, a vibration absorbing member 43 having high vibration absorption property, such as a high-polymer material, is disposed on one side of the leading end protrusion 34*d* of the latch 34 that abuts against the latch roller pin 12*a* in the closed state. This alleviates the bounce of the latch 34 due to collision between the latch 34 and the latch roller pin 12*a*, enhancing the effect of preventing coming off of the latch 34.

Other Embodiments

Although compression coil springs are used as the cutoff spring 6 and the closing spring 21 in the above embodiments, other elastic bodies, such as torsion coil springs, disc springs, spiral springs, plate springs, air springs, and tension springs may be used alternatively. Further, although a coil spring or torsion coil spring is used as the return springs 27, 33, 35, and 37 provided in the anchoring lever 26 for closing, the trigger lever 31, the latch 34, and the solenoid lever 36, other elastic bodies such as disc springs, spiral springs, or plate springs may be used alternatively.

The present invention can also be applied to an apparatus having a plurality of cutoff springs or plurality of the closing springs.

Although the pin 5*b* engaged with the end portion of the trigger lever return spring 33 and the pin 30*b* engaged with the end portion of the latch return spring 35 are separately disposed in the first embodiment, the functions of the above two pins may be provided by one pin Although the stopper pin 5*c* for restricting the rotation of the trigger lever 31 and the stopper pin 30*c* for restricting the rotation of the latch 34 are separately disposed in the first embodiment, the functions of the above two pins may be provided by one pin.

Further, since the anchoring lever 30 is fixed to the frame 5, it may be omitted. In this case, the pin 30*b* and the stopper pin 30*c*, etc., may be directly fixed to the frame 5. Further, the pin 30*b* and the stopper pin 30*c* may be integrated with the anchoring lever 30 or the frame 5.

Although the stopper pin 5*d* is used to restrict the clockwise rotation of the solenoid lever 36 by the solenoid lever return spring 37, the plunger 38*a* of the electromagnetic solenoid 38 for cutoff may be used in place of the stopper pin 5*d*.

Further, it is possible to provide a plurality of the rings 42 of the fourth embodiment (FIGS. 15 to 17). In this case, by making inner diameters and outer diameters of the respective rings 42 differ from one another, the rings 42 collide with the latch pin 34*e* with time lags, thereby enhancing the effect of preventing coming off of the latch 34. Further, by making weights of the respective rings 42 differ from one another, the rings 42 collide with the latch pin 34*e* with time lags, thereby enhancing the effect of preventing coming off of the latch 34.

Further, although the ring 42 of the fourth embodiment has a hollow doughnut-like shape, the shape of the ring 42 is not limited to that shape, but the same effect can be obtained even with a shape other than the hollow doughnut-like shape.

Further, although the latch pin 34*e* and the ring 42 are mounted to the latch 34 of the first embodiment in the fourth embodiment, the latch pin 34*e* and the ring 42 may be mounted to the latch 34 of the second, third, or fifth embodiment.

Further, although the vibration absorbing member 43 is attached to the latch 34 of the first embodiment in the fifth embodiment (FIG. 18), the vibration absorbing member may be alternatively attached to the leading end protrusion 34*d* of the latch 34 of the second, third or fourth embodiment.

Although the preferred embodiments of the present invention have been described above, the embodiments are merely illustrative and do not limit the scope of the present invention. These novel embodiments can be practiced in other various forms, and various omissions, substitutions and changes may be made without departing from the scope of the invention. The embodiments and modifications thereof are included in the scope or spirit of the present invention and in the appended claims and their equivalents.

What is claimed is:

1. A switchgear operating mechanism for reciprocatively driving a movable contact of a switchgear so as to shift the switchgear between a cutoff state and a closed state, the operating mechanism comprising:

a frame;

a closing shaft rotatably disposed relative to the frame;

a main lever fixed to the closing shaft and capable of being swung in conjunction with the movable contact;

a cutoff spring disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft disposed so as to be rotatable relative to the frame around a rotation axis substantially parallel to a rotation axis of the closing shaft;

a sub-lever swingably fixed to the sub-shaft;

a main-sub connection link rotatably connecting a leading end of the sub-lever and the main lever;

a cam mechanism swinging the sub-shaft in accordance with the rotation of the closing shaft;

a latch lever swingably fixed to the sub-shaft;

a latch roller pin rotatably mounted to a leading end of the latch lever;

a trigger lever disposed so as to be rotatable relative to the frame around a rotation axis substantially parallel to the rotation axis of the closing shaft;

a trigger roller pin rotatably mounted to a leading end of the trigger lever;

a trigger lever return spring biasing the trigger lever so as to rotate the trigger lever in a predetermined direction;

a latch fixed to the trigger lever at a position different from a rotation axis of the trigger lever so as to be rotatable around a rotation axis substantially parallel to the rotation axis of the closing shaft and having a leading end engageable with the latch roller pin;

a latch return spring biasing the latch so as to rotate the latch in a predetermined direction;

a solenoid lever disposed relative to the frame so as to be rotatable around a rotation axis substantially parallel to the rotation axis of the closing shaft and having a leading end engageable with the trigger roller pin;

a solenoid lever return spring biasing the solenoid lever so as to rotate the solenoid lever in a predetermined direction; and an electromagnetic solenoid for cutoff which acts against a biasing force of the solenoid lever return spring to push the solenoid lever so as to shift the switchgear operating state from the closed state to the cutoff state, wherein in a state where the switchgear operating state is shifted from the closed state to the cutoff state, the solenoid lever is pushed by the electromagnetic solenoid for cutoff so as to be rotated in an opposite direction to the biasing direction of the solenoid lever return spring to release an engagement between the trigger roller pin and the solenoid lever, and the trigger lever and an eccentric pin are rotated by the biasing force of the latch roller pin to release an engagement between the latch roller pin and the leading end of the latch, which causes the cutoff spring to discharge its energy to rotate the latch lever.

2. The switchgear operating mechanism according to claim 1, further comprising:

an eccentric pin fixed to the trigger lever at the rotation axis center portion of the trigger lever so as to be rotatably supported relative to the frame and supporting the latch so as to allow the latch to rotate around a rotation axis center different from the rotation axis center of the trigger lever.

3. The switchgear operating mechanism according to claim 1, wherein the leading end of the solenoid lever engageable with the trigger roller pin has a plane normal to a line connecting the rotation axis center of the trigger roller pin and the rotation axis center of the solenoid lever.

4. The switchgear operating mechanism according to claim 1, wherein the leading end of the solenoid lever engageable with the trigger roller pin has a convex cylindrical surface having its curvature center axis on a line connecting the rotation axis center of the trigger roller pin and the rotation axis center of the solenoid lever.

5. The switchgear operating mechanism according to claim 1, wherein the leading end of the latch engageable with the latch roller pin has a plane normal to a line connecting the rotation axis center of the latch roller pin and the rotation axis center of the latch.

6. The switchgear operating mechanism according to claim 1, wherein the leading end of the latch engageable with the latch roller pin has a convex cylindrical surface having its center on a line connecting the rotation axis center of the latch roller pin and the rotation axis center of the latch.

7. The switchgear operating mechanism according to claim 1, further comprising:

a latch pin fixed to the latch; and a ring having an inner diameter larger than an outer diameter of the latch pin and disposed surrounding an outer periphery of the latch pin in a radial direction so as to be movable in the radial direction of the latch pin.

8. The switchgear operating mechanism according to claim 2, wherein the leading end of the solenoid lever engageable with the trigger roller pin has a plane normal to a line connecting the rotation axis center of the trigger roller pin and the rotation axis center of the solenoid lever.

9. The switchgear operating mechanism according to claim 2, wherein the leading end of the solenoid lever engageable with the trigger roller pin has a convex cylindrical surface having its curvature center axis on a line connecting the rotation axis center of the trigger roller pin and the rotation axis center of the solenoid lever.

10. The switchgear operating mechanism according to claim 2, wherein the leading end of the latch engageable with the latch roller pin has a plane normal to a line connecting the rotation axis center of the latch roller pin and the rotation axis center of the latch.

11. The switchgear operating mechanism according to claim 2, wherein the leading end of the latch engageable with the latch roller pin has a convex cylindrical surface having its center on a line connecting the rotation axis center of the latch roller pin and the rotation axis center of the latch.

12. The switchgear operating mechanism according to claim 2, further comprising:

a latch pin fixed to the latch; and a ring having an inner diameter larger than an outer diameter of the latch pin and disposed surrounding an outer periphery of the latch pin in a radial direction so as to be movable in the radial direction of the latch pin.

13. The switchgear operating mechanism according to claim 2, wherein a leading end protrusion is formed such that it protrudes from the leading end of the latch so as to be capable of contacting the latch roller pin at one side of a position at which the leading end of the latch is engaged with the latch roller pin before and after the closed state.

14. The switchgear operating mechanism according to claim 13, wherein a vibration absorbing member absorbing vibration generated when the latch roller pin and the leading end protrusion contact each other immediately before the switchgear operating state is shifted to the closed state is attached to the leading end protrusion.

15. The switchgear operating mechanism according to claim 2, comprising:

a closing lever fixed to the closing shaft;

a closing link rotatably connected to the closing lever; and a closing spring disposed between the leading end of the closing link and the frame so as to bias the leading end of the closing link in a direction away from the closing shaft.

16. The switchgear operating mechanism according to claim 15, wherein the closing spring is disposed such that it accumulates energy in the closed state or cutoff state in accordance with the rotation of the closing shaft while it discharges its accumulated energy when the switchgear operating state is shifted from the cutoff state to the closed state.

17. The switchgear operating mechanism according to claim 15, further comprising:

a tab disposed at the leading end of the closing lever; and a retention unit engaged with the tab, wherein:

the retention unit has; anchoring lever for closing having a half-column portion; a return spring for biasing the anchoring lever for closing in a predetermined direction; and an electromagnetic solenoid for closing driving the retention unit against the biasing force of the return spring to move the anchoring lever for closing so as to shift the switchgear operating state from the cutoff state to the closed state.

18. The switchgear operating mechanism according to claim 1, wherein a leading end protrusion is formed such that it protrudes from the leading end of the latch so as to be capable of contacting the latch roller pin at one side of a position at which the leading end of the latch is engaged with the latch roller pin before and after the closed state.

19. The switchgear operating mechanism according to claim 18, wherein a vibration absorbing member absorbing vibration generated when the latch roller pin and the leading end protrusion contact each other immediately before the switchgear operating state is shifted to the closed state is attached to the leading end protrusion.

20. The switchgear operating mechanism according to claim 1, comprising:

a closing lever fixed to the closing shaft;

a closing link rotatably connected to the closing lever; and a closing spring disposed between the leading end of the closing link and the frame so as to bias the leading end of the closing link in a direction away from the closing shaft.

21. The switchgear operating mechanism according to claim 20, wherein the closing spring is disposed such that it accumulates energy in the closed state or cutoff state in accordance with the rotation of the closing shaft while it discharges its accumulated energy when the switchgear operating state is shifted from the cutoff state to the closed state.

22. The switchgear operating mechanism according to claim 20, further comprising:

a tab disposed at the leading end of the closing lever; and a retention unit engaged with the tab, wherein:

the retention unit has; anchoring lever for closing having a half-column portion; a return spring for biasing the anchoring lever for closing in a predetermined direction; and an electromagnetic solenoid for closing driving the retention unit against the biasing force of the return spring to move the anchoring lever for closing so as to shift the switchgear operating state from the cutoff state to the closed state.

23. A switchgear having a movable contact that can be moved in a reciprocating manner and an operating mechanism that drives the movable contact and configured to be shifted between a cutoff state and a closed state by the movement of movable contact, the operating mechanism comprising:

a frame;

a closing shaft rotatably disposed relative to the frame;

a main lever fixed to the closing shaft and capable of being swung in conjunction with the movable contact;

a cutoff spring disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft disposed so as to be rotatable relative to the frame around a rotation axis substantially parallel to a rotation axis of the closing shaft;

a sub-lever swingably fixed to the sub-shaft;

a main-sub connection link rotatably connecting a leading end of the sub-lever and the main lever;

a cam mechanism swinging the sub-shaft in accordance with the rotation of the closing shaft;

a latch lever swingably fixed to the sub-shaft;

a latch roller pin rotatably mounted to a leading end of the latch lever;

a trigger lever disposed so as to be rotatable relative to the frame around a rotation axis substantially parallel to the rotation axis of the closing shaft;

a trigger roller pin rotatably mounted to a leading end of the trigger lever;

a trigger lever return spring biasing the trigger lever so as to rotate the trigger lever in a predetermined direction;

a latch fixed to the trigger lever at a position different from a rotation axis of the trigger lever so as to be rotatable around a rotation axis substantially parallel to the rotation axis of the closing shaft and having a leading end engageable with the latch roller pin;

a latch return spring biasing the latch so as to rotate the latch in a predetermined direction;

a solenoid lever disposed relative to the frame so as to be rotatable around a rotation axis substantially parallel to the rotation axis of the closing shaft and having a leading end engageable with the trigger roller pin;

a solenoid lever return spring biasing the solenoid lever so as to rotate the solenoid lever in a predetermined direction; and an electromagnetic solenoid for cutoff which acts against a biasing force of the solenoid lever return spring to push the solenoid lever so as to shift the switchgear operating state from the closed state to the cutoff state, wherein in a state where the switchgear operating state is shifted from the closed state to the cutoff state, the solenoid lever is pushed by the electromagnetic solenoid for cutoff so as to be rotated in an opposite direction to the biasing direction of the solenoid lever return spring to release an engagement between the trigger roller pin and the solenoid lever, and the trigger lever and an eccentric pin are rotated by the biasing force of the latch roller pin to release an engagement between the latch roller pin and the leading end of the latch, which causes the cutoff spring to discharge its energy to rotate the latch lever.

* * * * *